US011011859B1

(12) United States Patent
Zellner et al.

(10) Patent No.: US 11,011,859 B1
(45) Date of Patent: May 18, 2021

(54) PLUG-TYPE CONNECTOR WITH INSULATION DISPLACEMENT CONTACT

(71) Applicant: HARTING Electronics GmbH, Espelkamp (DE)

(72) Inventors: Joachim Zellner, Rinchnach (DE); Matthias Jungbeck, Teisnach (DE); Ernst Klees, Munich (DE)

(73) Assignee: HARTING Electronics GmbH, Espelkamp (DE)

( * ) Notice: Subject to any disclaimer, the term of this patent is extended or adjusted under 35 U.S.C. 154(b) by 74 days.

(21) Appl. No.: 16/610,881

(22) PCT Filed: May 14, 2018

(86) PCT No.: PCT/EP2018/062322

§ 371 (c)(1),
(2) Date: Nov. 4, 2019

(87) PCT Pub. No.: WO2018/210716

PCT Pub. Date: Nov. 22, 2018

(30) Foreign Application Priority Data

May 15, 2017 (DE) ..... 10 2017 110 544.1

(51) Int. Cl.
*H01R 4/2433* (2018.01)
*H01R 13/506* (2006.01)
(Continued)

(52) U.S. Cl.
CPC ..... *H01R 4/2433* (2013.01); *H01R 13/506* (2013.01); *H01R 24/64* (2013.01); *H01R 2107/00* (2013.01)

(58) Field of Classification Search
CPC ..... H01R 4/2433; H01R 13/506; H01R 2107/00; H01R 24/64
(Continued)

(56) References Cited

U.S. PATENT DOCUMENTS 7,559,790 B2 * 7/2009 Boeck ..... H01R 24/64 439/409
8,192,224 B2 * 6/2012 Schmidt ..... H01R 24/64 439/409
(Continued)

FOREIGN PATENT DOCUMENTS

DE 102010021871 A1 12/2010
DE 202012100261 U1 12/2012
(Continued)

*Primary Examiner* — Gary F Paumen
(74) *Attorney, Agent, or Firm* — Smartpat PLC

(57) ABSTRACT

A plug-type connector for connecting a cable with at least one wire to a respective plug contact includes a first housing part, a connection block and a second housing part. A hinge connection allows the second housing part to pivot out of a first position into a second position towards the first housing part. In the first position the wire can be inserted into a wire channel of the connection block and, in the second position, the second housing part presses the connection block against the insulation displacement contact. The second housing part can move into a third position in which the connection block is fully pressed onto the insulation displacement contact. The hinge connection allows an insertion movement from the second into the third position such that the second housing part inserts the wire into the insulation displacement contact in an exclusively translatory manner.

15 Claims, 7 Drawing Sheets

(51) Int. Cl.
*H01R 107/00* (2006.01)
*H01R 24/64* (2011.01)

(58) Field of Classification Search
USPC ..... 439/409, 410, 417, 418
See application file for complete search history.

(56) References Cited

U.S. PATENT DOCUMENTS

| | | | | |
|---|---|---|---|---|
| 8,573,999 | B2 * | 11/2013 | Feldner | H01R 24/64 439/409 |
| 8,702,444 | B2 * | 4/2014 | Maranto | H01R 13/5825 439/467 |
| 9,799,982 | B1 * | 10/2017 | Lin | H01R 4/2429 |
| 2005/0260882 | A1 * | 11/2005 | Bernat | H01R 24/64 439/409 |
| 2010/0015844 | A1 | 1/2010 | Martin et al. | |
| 2014/0273605 | A1 | 9/2014 | Chang et al. | |
| 2015/0236432 | A1 * | 8/2015 | Lin | H01R 13/5841 439/367 |
| 2016/0072235 | A1 | 3/2016 | Strelow et al. | |
| 2018/0115113 | A1 | 4/2018 | Lin | |

FOREIGN PATENT DOCUMENTS

| | | | |
|---|---|---|---|
| DE | 102013209327 | | 2/2015 |
| DE | 202014010869 | U1 | 12/2016 |
| DE | 102016004429 | A1 | 10/2017 |
| EP | 2806500 | A1 | 11/2014 |
| JP | 2010277861 | A | 12/2010 |
| TW | M536801 | U | 2/2017 |
| WO | 2008071917 | A1 | 6/2008 |
| WO | 2013111083 | A1 | 8/2013 |

* cited by examiner

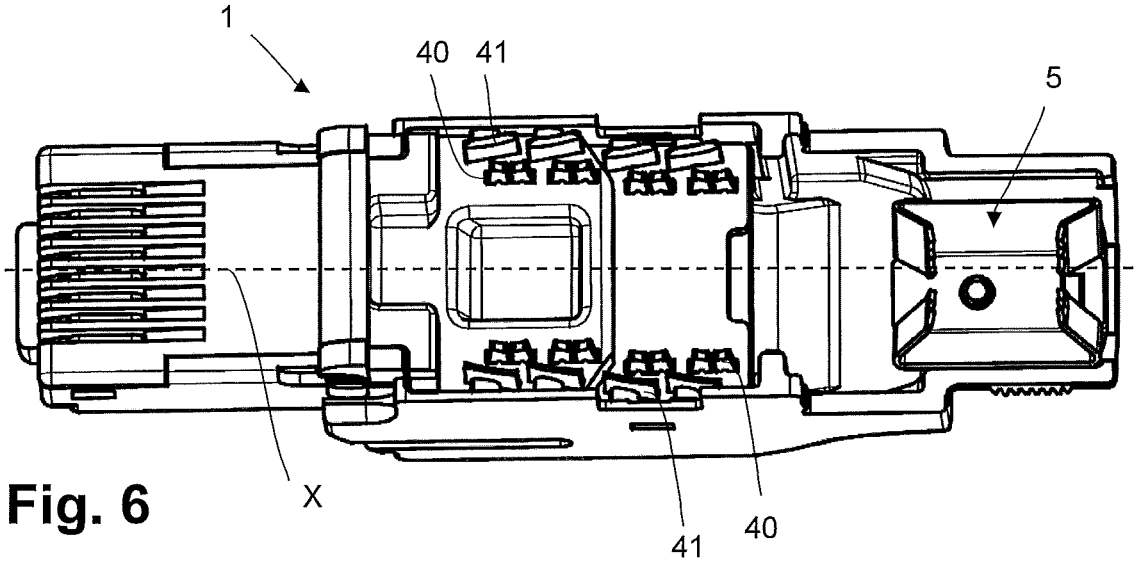
Fig. 6
Fig. 7
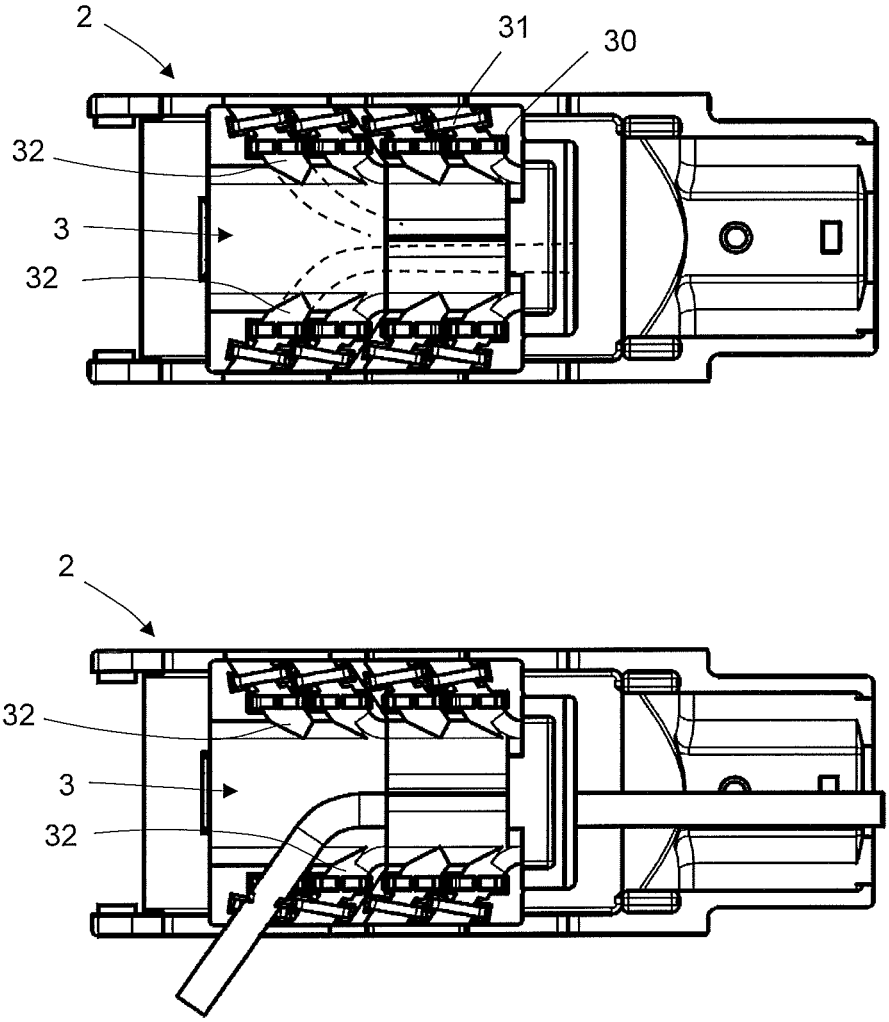

PLUG-TYPE CONNECTOR WITH INSULATION DISPLACEMENT CONTACT

TECHNICAL FIELD

The present disclosure concerns a plug-type connector with an insulation displacement contact, wherein the plug-type connector has a first and a second housing part.

BACKGROUND

Various plug-type connectors with insulation displacement contacts are known, in which respective wires of a cable are pressed into the corresponding insulation displacement contacts and contacted, where possible on assembly by simultaneous pressing together of the housing parts. As the insulation displacement contacts, otherwise known as ID terminations, become ever smaller, at the same time the requirements for precise insertion of the respective wire into the respective ID termination increase, wherein also a wire casing must be cut and the electrical wire lying therein contacted reliably. Also, cost aspects are important, given the increasing number of wiring connections, for example with RJ45 plug-type connectors.

WO2013/111083A1 discloses a plug-type connector in which the wires are pressed into the ID terminations that are connected to a contact circuit board, by means of a separate specific pressing part. Then the contact circuit board with the ID terminations and separate pressing part is placed in a first housing part and closed with a second housing part. Overall, the plug-type connector comprises a plurality of individual components which are costly.

DE102013209327B4 describes a plug-type connector with ID terminations, wherein the housing consists substantially of three complex parts, wherein two housing parts are rotatably attached to a first housing part. The rotational movement of the two housing parts around the first housing part leads to a circular insertion movement on clamping of the wires into the respective ID termination, so that the ID terminations and the wires are necessarily bent. This unnecessarily strains the respective ID termination and the wire, which adversely affects the reliability of the contact connection.

WO2008/071917A1 also discloses a plug-type connector with ID terminations, wherein the housing substantially consists of three complex parts, and the two housing parts are attached rotatably to the first housing part. Here too, the circular movement causes a bending of the ID termination or pushes the wire forward and back in the ID termination on clamping or pressing.

WO 2008071917A1 describes a plug-type housing with at least one plug-type housing part which can fold about a rotation axis and can be pressed onto a second plug-type housing part with the ID terminations, by rotation in circular fashion about the rotation axis.

DE102016004429A1 discloses a plug-type housing with two plug-type housing parts which are each pivotable about a respective rotation axis and each equipped with ID terminations, and which can be pivoted towards each other about the respective rotation axis by a base part and connected together. The mechanism is complex, wherein the wires are not introduced into the ID terminations in precisely one predefined insertion direction.

SUMMARY

The object of the disclosure is to eliminate the disadvantages of the prior art, and therefore consists of the provision of a plug-type connector with which a respective cable wire can be guided into a respective ID termination during pressing, as far as possible in a straight line in a cutter inlet direction of the ID termination, wherein the plug-type connector consists of as few parts as possible and is simple and economic to construct.

The above object is achieved by a plug-type connector as claimed.

A plug-type connector for connecting a cable is provided, wherein the cable has at least one wire and is connected in the plug-type connector to a respective plug contact (42), the plug-type connector comprising:

- a first housing part (1) with a first housing part longitudinal axis (X), comprising at least one plug contact (42) and at least one insulation displacement termination (40) which is electrically connected to the respective plug contact (42) and configured such that it has an insertion slot with a cutter inlet direction (Z) for a respective wire, in order to clamp the respective wire therein;
- a connection block (3) with a respective wire channel (32) for guiding the respective wire; and
- a second housing part (2) with a second housing part longitudinal axis, comprising the connection block (3);
- wherein the first housing part (1) and the second housing part (2) are connected together by means of a common hinge connection with a rotation axis;
- wherein the hinge connection is configured such that the second housing part (2) can be pivoted about the rotation axis towards the first housing part (1) from a first position into a second position, wherein in the first position the respective wire can be inserted into the respective wire channel (32) of the connection block (3), and in the second position the second housing part (2) just begins to press the connection block (3), with the respective wire guided in the respective wire channel (32), against the respective insulation displacement termination (40); and
- wherein the hinge connection is configured to allow the second housing part (2) to move on the first housing part (1) out of the second position into a third position, in which the connection block (3), with the respective wire guided in the respective wire channel (32), is fully pressed onto the at least one insulation displacement termination; and
- wherein the hinge connection is furthermore configured to allow an insertion movement out of the second position into the third position such that the second housing part (2) inserts the respective wire into the respective insulation displacement termination (40) in an exclusively translational fashion in the cutter inlet direction (Z) towards the first housing part (1).

Because the hinge movement from the second to the third position now no longer takes place in a further circular insertion movement, as in the prior art, but in an exclusively translational insertion movement, the wires may be guided precisely into the respective ID termination in the cutter inlet direction. The ID terminations are preferably configured with a rectilinear insertion slot which is easy to produce at low cost. Thus a sheathing or insulation of the respective wire can be cut precisely along an insertion slot of the respective ID termination and pushed apart, and a central conductor can be brought into contact with the ID termination or inserted and pressed therein. The disadvantages occurring in the prior art, in which the wire is pressed into the ID terminations in a further circular insertion movement, wherein the wires are not only pressed into the ID termination but also displaced perpendicularly thereto, are eliminated by the disclosed device. The purely translational insertion movement introduces the wires exclusively translationally into the insertion slot of the ID termination.

The disclosed plug-type connector avoids the unnecessary bending of the ID termination or wire, as occurs on a circular insertion movement according to the prior art. Also, an ID termination recess in the connection block, which is pushed onto the ID termination on the insertion movement, may be adapted substantially more closely to the ID termination without any seizing occurring, wherein the outer contour along an end portion of the ID termination is preferably rectilinear and parallel. Because the ID termination recess can lie more closely on the ID termination, the wires may also be introduced into the ID termination more precisely and with less play, as the person skilled in the art of geometry and trigonometry can easily understand.

Due to the exclusively translational insertion movement between the second and third positions, in particular the connection block with the respective ID termination recess can be designed more simply. Preferably, also the connection block and the second housing part may be formed integrally with each other so that fewer separate parts, which could otherwise also become lost, are required on installation.

Since the hinge connection in the plug-type connector is preferably formed by two latching pegs and a respective first recess, the rotatability about a rotation axis from the first to the second position can be easily produced. The first or second housing part with the respective first recess is preferably also formed with a respective second recess into which the latching pegs can move in the third position, allowing a simple, precise and economic design with which both the rotational and the translational movement of the second housing part relative to the first housing part can be achieved. A channel, preferably formed between the first recess and the second recess, guides the respective latching peg along a straight line or in a direction which corresponds to the cutter inlet direction.

Further advantages are presented in the detailed description.

Preferred embodiments according to the present invention are depicted in the drawings which follow and in a detailed description, without restricting the present invention exclusively thereto.

BRIEF DESCRIPTION OF THE DRAWINGS

FIG. 1 is a perspective view of a preferred plug-type housing with a first housing part and a second housing part and a connection block in between.

FIG. 6 is a view from below of the first housing part from FIG. 1 with ID terminations arranged therein.

FIG. 7 is a view from above of the second housing part from FIG. 1, showing the connection block with ID termination recesses, into which the ID terminations move from the second position.

DETAILED DESCRIPTION

Figure 1:
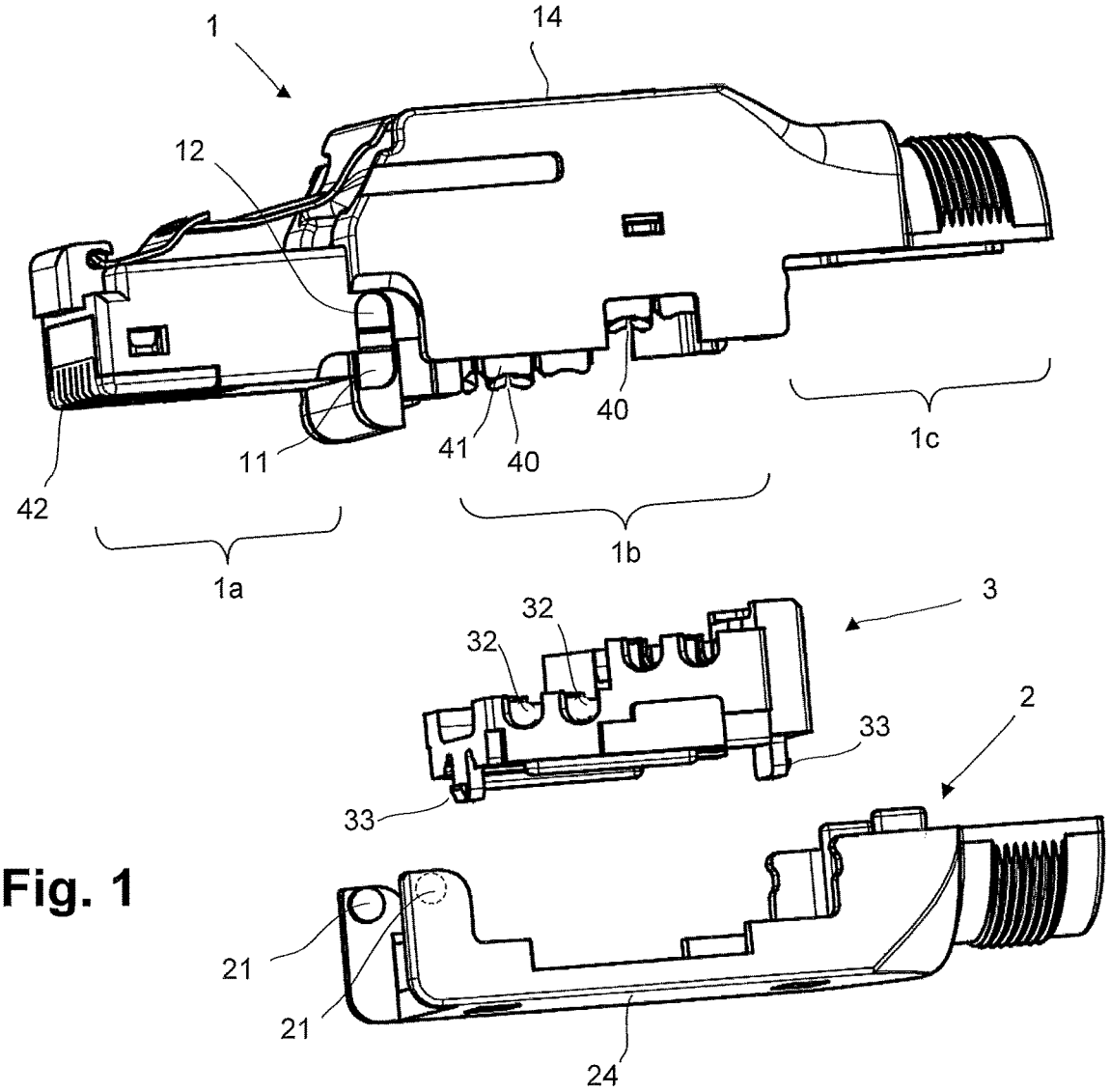

A plug-type connector to which a cable is to be connected comprises at least one plug contact 42 to which a respective wire of the cable can be connected electrically. The cable may have a single wire or a plurality of wires, each of which has a conductor and an insulation or wire sheathing. The conductor may consist of one wire or a bundle of wires. Preferably, the cable is connected to the plug-type connector so as to be secure against tension and compression. As presented in FIG. 1 as a preferred exemplary embodiment, the plug-type connector comprises the following:

a) a first housing part 1 which is preferably formed along a first housing part longitudinal axis X, and which comprises at least one plug contact 42 and at least one ID termination 40 which is electrically connected to the respective plug contact 42. The ID termination has an insertion slot with a cutter inlet direction Z, along which the respective wire is inserted in order be clamped therein;

b) a connection block 3 with a respective wire channel 32 for guiding the respective wire; and c) a second housing part 2 which is formed along a second housing part longitudinal axis and to which the connection block 3 is connected. The second housing part 2 and the connection block 3 may be constructed either as separate parts which can be connected together, or they are formed as an integral part. For example, the second housing part 2 and the connection block 3 are configured such that they can be pushed one into the other, for example by a clamping and/or latching and/or snap connection. For example, the connection block 3 may comprise latching lugs 33 which can be clipped into corresponding holes in the second housing part 2.

d) The first housing part 1 and the second housing part 2 are connected together by means of a common hinge connection with a rotation axis.

e) Here, the hinge connection is configured such that the second housing part 2 can be pivoted about the rotation axis towards the first housing part 1 from a first position into a second position. In the first position, the respective wire can be inserted into the respective wire channel 32 of the connection block 3. The cable is preferably connected to the second plug-type housing 2 or arranged between the first 1 and second plug-type housing 2 so that the wires remain in a correct position in the connection block 3. The second position of the second housing part 2 relative to the first housing part 1 begins at a point when the connection block 3, with the respective wire guided in the respective wire channel 32, begins to press against or touch the respective ID termination 40.

f) The hinge connection is also configured such that the second housing part 2 can be moved on the first housing part 1 out of the second position into a third position, in which the connection block 3, with the respective wire guided in the respective wire channel 32, is fully pressed onto the at least one ID termination.

g) The hinge connection is furthermore configured to allow an insertion movement out of the second position into the third position such that the second housing part 2 can be moved exclusively in a translational fashion in the cutter inlet direction Z towards the first housing part 1, wherein the respective wire is inserted into the respective ID termination 40 also in an exclusively translational fashion.

As FIG. 1 shows, the hinge connection is preferably configured such that in a rotation axis region, in each case lying laterally outwardly opposite each other, the first housing part 1 has first recesses 11 which together form the rotation axis between them. In the rotation axis region, the second housing part 2 has two legs which surround the first housing part 1, and two latching pegs 21 which extend inwardly towards each other along the rotation axis. The latching pegs 21 are arranged and oriented such that they engage in the respective first recesses 11 of the first housing part 1 and form part of the hinge connection with the rotation axis.

Figure 2:
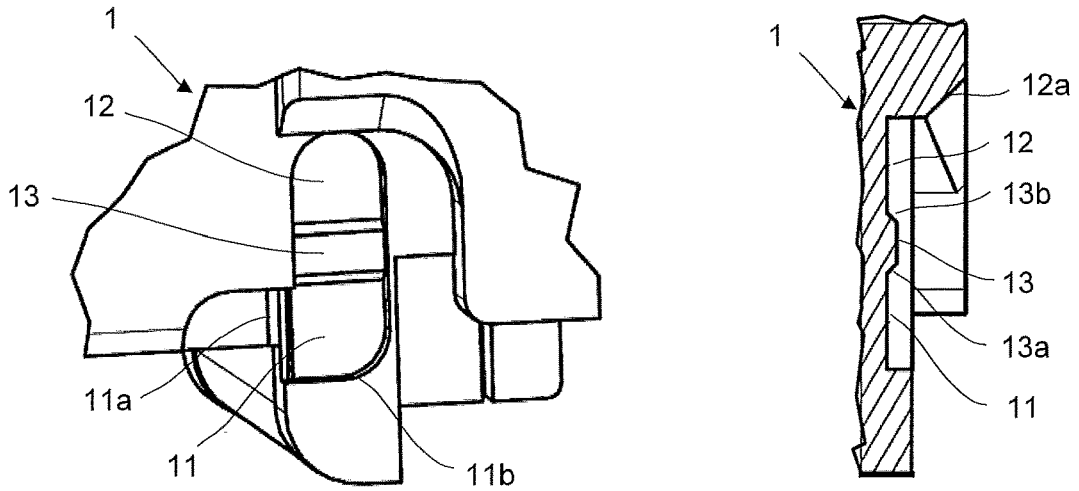
FIG. 2 shows, on the left side, a perspective, enlarged view of an extract of the preferred plug-type housing from FIG. 1, and on the right side, a side view as a sectional view of an extract of the preferred plug-type housing shown on the left side.

FIG. 2 shows an enlarged extract of the preferred hinge connection from FIG. 1. The first recesses 11 can be seen more clearly here, and the right-hand part of the figure shows a sectional depiction in a view rotated through 90° relative to the left-hand depiction, in which a depression of the first recess 11 in the first housing part 1 can be seen. Preferably, a diameter of the first recess 11 is generally adapted to the respective latching peg 21 such that the second housing part 2 can rotate with as little play as possible.

The preferred plug-type connector in FIG. 1 has a front portion 1*a* in which a series of plug contacts 42 is arranged, a middle portion 1*b* in which the ID terminations 40 are arranged, and a rear portion which contains a tension and compression relief means. As an example, FIG. 1 shows an RJ45 plug-type connector. The preferred plug-type connector also has cutting means 41 in the middle portion 1*b*, which have an outer sharp edge for cutting the wire and are arranged such that a portion of the respective wire protruding behind the respective ID termination is automatically cut off during the insertion movement into the third position.

Figure 3:
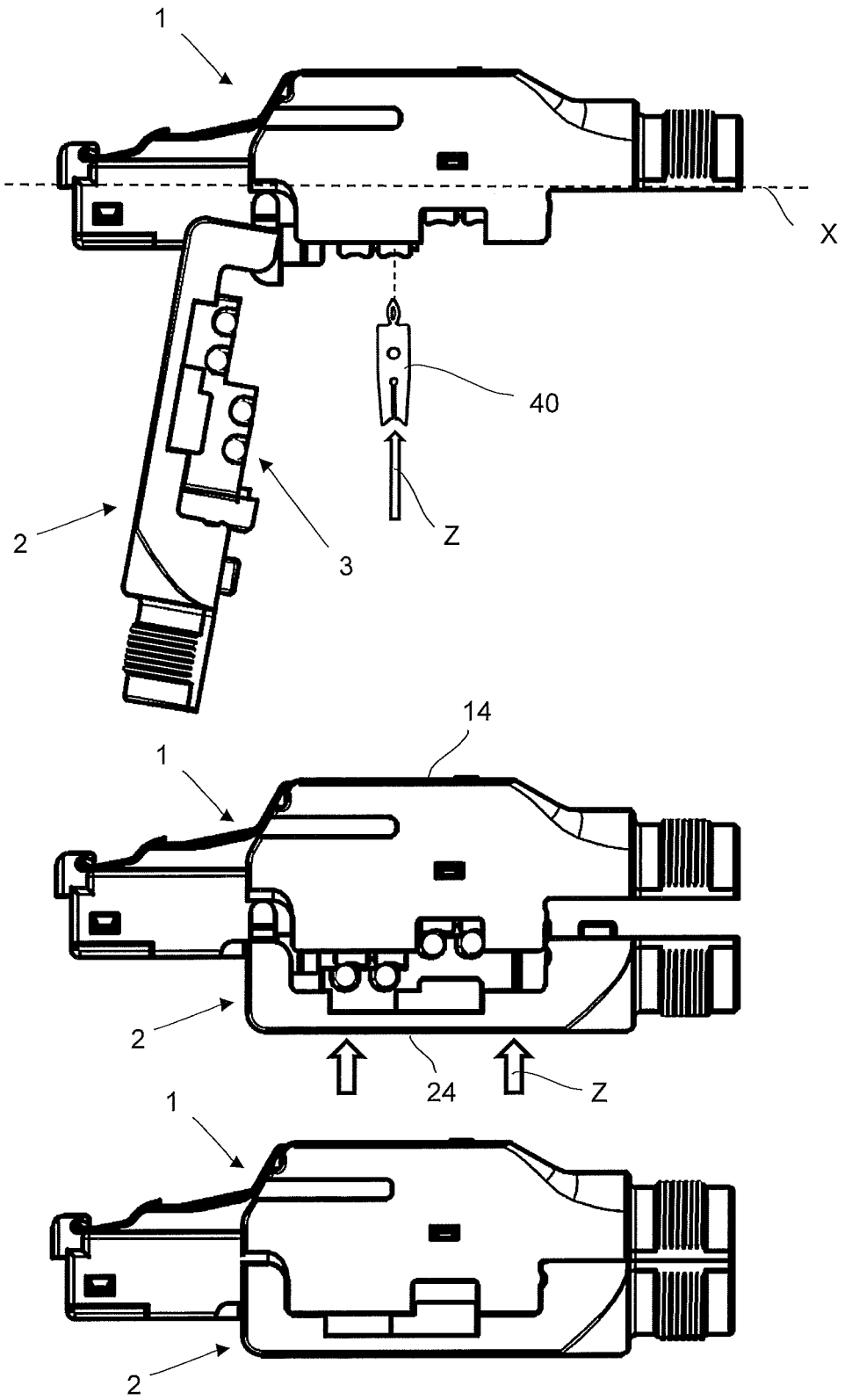
FIG. 3 is a side view of the preferred plug-type housing from FIG. 1 with the first housing part, the second housing part and the connection block which is connected integrally to the second housing part, wherein the second plug-type housing is shown in three positions: at the top in the drawing, in a first or starting position; in the middle, in a second position; and at the bottom, in a third position in which the first and second housing parts are fully connected together.

FIG. 3 shows the preferred plug-type connector at the top in the first position in which the second housing part 2 is opened wide, wherein the ID termination 40 is extracted from the first housing part 1 and shown with the cutter inlet direction Z. The middle image part of FIG. 3 shows the preferred plug-type connector in the second position, and the lower image part shows this in the third position. The first housing part 1 here has a first, upper outer face 14 which is preferably at least partially perpendicular to the cutter inlet direction Z, in which the first 1 and second housing part 2 are pressed together from the second into the third position. The second housing part 2 has a second, lower outer face 24 which is preferably at least partially perpendicular to the cutter inlet direction Z.

Figure 4:
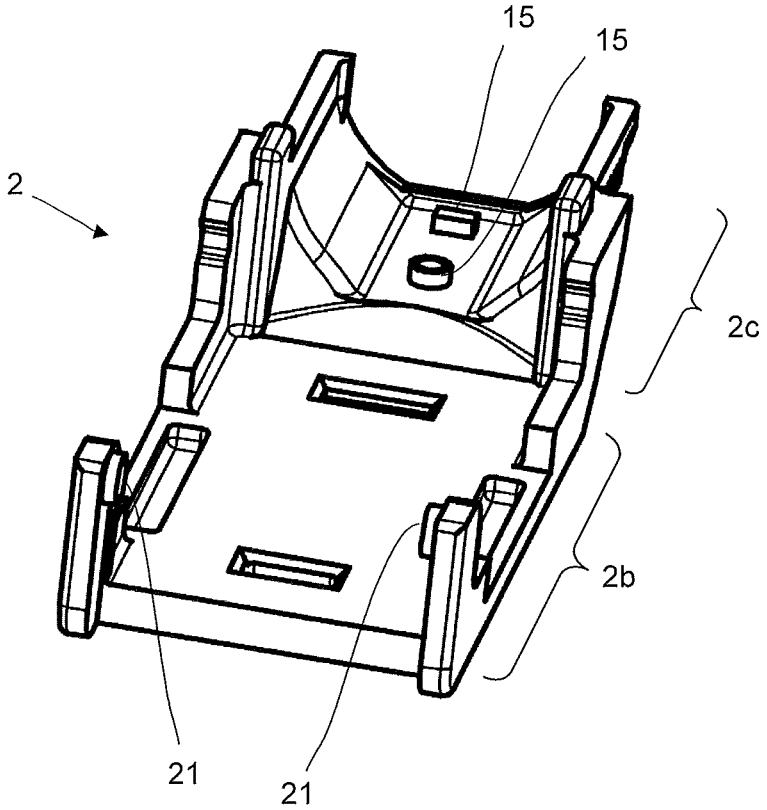
FIG. 4 is a perspective, enlarged view of the second housing part from FIG. 1.

FIG. 4 shows the preferred second housing part 2 with a corresponding second middle portion 2*b* and a second rear portion 2*c*, which preferably lie above the respective middle portion 1*b* and rear portion 1*c* of the first housing part. In the region of the tension and compression relief means, the first 1 and/or second housing part 2 preferably comprises a second mechanical contact element 15 which can be connected to the corresponding tension and compression relief means. For connection to the second mechanical contact element 15, the tension and compression relief means preferably has a suitable, corresponding first mechanical contact element.

Figure 5:
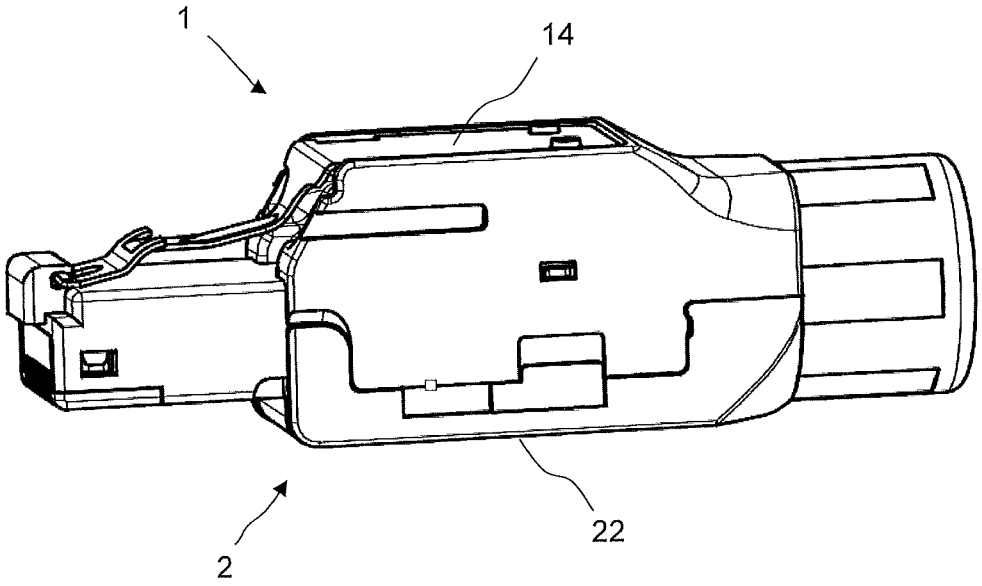
FIG. 5 is a perspective view of the plug-type housing from FIG. 1 and FIG. 3, wherein the second housing part is fully connected to the first housing part, and also an end cap is screwed onto a rear portion which preferably contains a tension and compression relief means.

FIG. 5 shows the preferred plug-type connector in the third position with an end cap which is screwed onto the first and second rear portions.

FIG. 6 shows a view from below onto the preferred first housing part 1 from FIG. 1, with the ID terminations 40 arranged therein and the cutting means 41, which are each arranged next to the respective ID terminations 40 such that they cut the respective portion of the respective wire protruding from the connection block 3 during the insertion movement from the second to the third position.

FIG. 7 shows a view from above onto the preferred second housing part 2 and connection block 3 from FIG. 1, wherein the connection block 3 is formed with ID termination recesses 30 which, during the insertion movement, receive a respective end portion of the respective ID termination. Also, the preferred embodiment comprises cutting means recesses 31 which are configured to receive the cutting means 41 during the insertion movement and press the respective wire on both sides against the sharp edge of the cutting means 41. The respective wire channels 32 are shown in dotted lines, wherein a first channel portion of the respective wire channel is preferably configured as a bore through which the respective wire is guided, a second channel portion is configured as a cavity in which the wires can be freely bent, and a third channel portion of the respective wire channel comprises a bore substantially half open at the top, and with a side clamping guide for keeping the wire guided in a region of the ID termination 40 and preferably of the cutting means 41. The lower part of the figure shows the second housing part 2 with the connection block 3 as in the top of the image, but with a wire laid in place.

Figure 8:
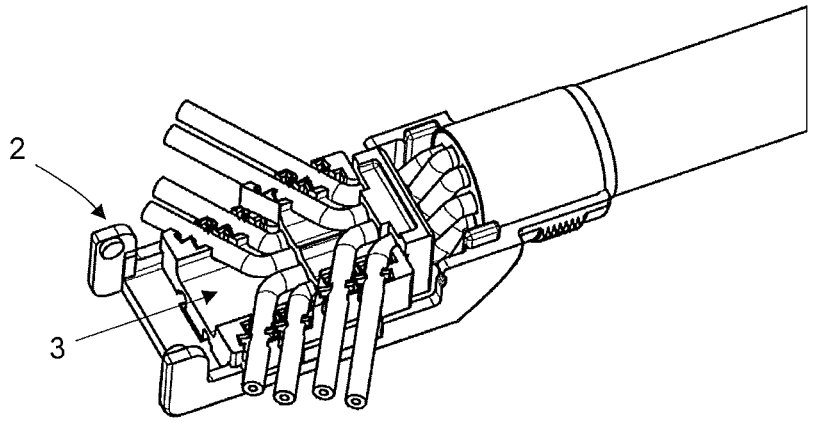
FIG. 8 is a perspective view of the second housing part from FIG. 1 and FIG. 3, wherein the connection block is integrally connected to the second housing part, and a cable with outwardly protruding wires or cable cores is laid in the connection block.

FIG. 8 is a perspective view of the second housing part 2 with the connection block 3 from FIG. 7, wherein the cable is mounted with the outwardly protruding wires or cable cores which are laid in the connection block and held clamped therein.

Figure 9:
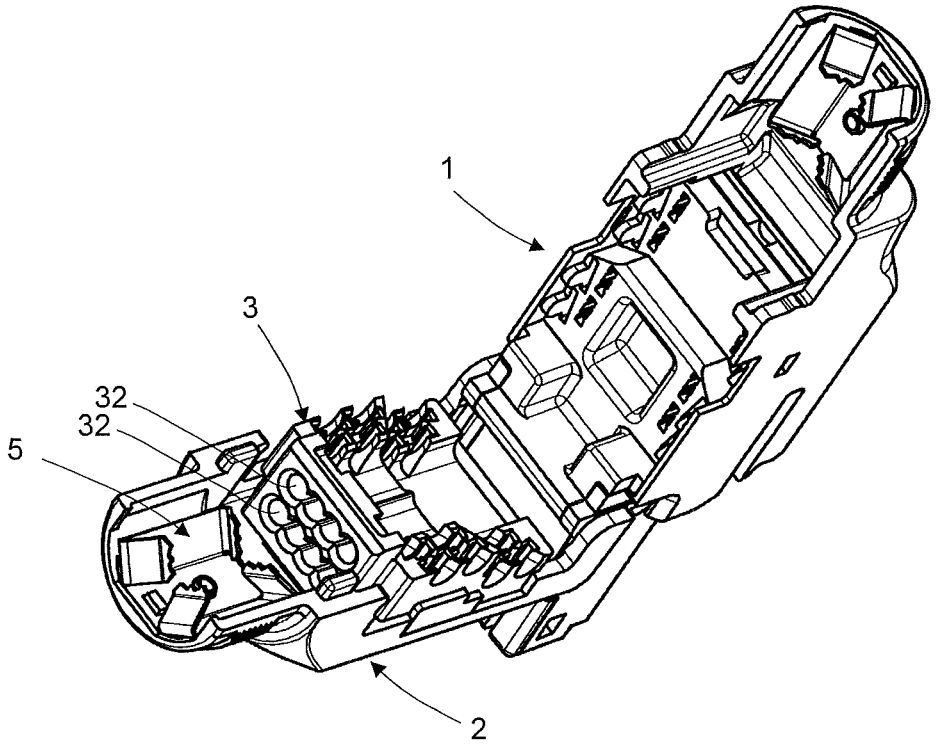
FIG. 9 is a perspective view of the plug-type housing from FIG. 1 in the first position in which the cable may be placed therein.

FIG. 9 in turn shows a perspective view of the preferred plug-type connector from FIG. 1 in the first position, wherein the first 1 and the second housing part 2 and the connection block 3 are connected together. In the connection block 3, the wire channels 32 are shown with their respective first portions which are preferably bores. The tension and compression relief means are arranged in both the first rear portion 1*c* of the first housing part 1 and in the second rear portion 2*c* of the second housing part 2.

Preferably, the hinge connection may be configured such that in the rotation axis region, in each case lying laterally outwardly opposite each other, the first housing part 1 comprises the latching pegs 21 which extend outwardly along the rotation axis and engage in the respective first recesses 11, wherein in the rotation axis region, the second housing part 2 has the two legs which surround the first housing part 1 in the rotation axis region and which have the respective first recesses 11 facing each other on the inside.

Alternatively, preferably the hinge connection may be configured in that in the rotation axis region, in each case lying laterally outwardly opposite each other, the second housing part 2 has the first recesses 11 which are formed along the rotation axis and receive the respective latching pegs 21 of the first housing part 1, wherein in the rotation axis region, the first housing part 1 has the two legs which surround the second housing part 2 in the rotation axis region and comprise the respective latching pegs 21, wherein the two latching pegs 21 extend towards each other.

Alternatively preferably, the hinge connection may be configured in that in the rotation axis region, in each case lying laterally outwardly opposite each other, the second housing part 2 comprises the latching pegs 21 which extend outwardly along the rotation axis and engage in the respective first recesses 11, wherein in the rotation axis region, the first housing part 1 has the two legs which surround the second housing part 2 in the rotation axis region and which have the respective first recesses 11 facing each other on the inside.

Preferably, the first 1 or the second housing part 2 with the two first recesses 11 comprises two second recesses 12, which are arranged relative to the first recesses 11 such that, in the third position, the two latching pegs 21 are received in the two second recesses 12. The preferred respective latching peg 21 thus moves from the respective first recess 11 into the respective second recess 12 on movement from the second position to the third position.

Preferably, a respective channel is formed between the respective first recesses 11 and second recesses 12, as shown in FIG. 2, in order to guide the respective latching peg 21 from the second position into the third position. Here, the respective latching peg 21 is guided in a straight line in the cutter inlet direction Z.

Preferably, between the respective first recess 11 and the second recess 12, the channel has a relative elevation 13, as shown in FIG. 2, which however lies lower then an outer level of the first recess 11 and second recess 12, in order to guide the respective latching peg 21 therein. In other words, the respective relative elevation 13 is not as deep as the respective first 11 and second recess 12, but still deep enough for the latching peg 21 not to jump out of the channel but to remain guided by the channel.

Preferably, the first recess 11 has a second chamfer 13*a* from the inner level of a region of a greatest depth to the relative elevation 13, wherein the second chamfer 13*a* as a ramp has a ramp angle from 1° to 60° from the inner level. A ramp angle of 1° would mean almost flat, whereas a ramp angle of 90° would mean a vertical edge.

Preferably, the second recess 12 has a third chamfer 13*b* from the inner level of a region of a greatest depth to the relative elevation 13 with a ramp angle of less than 60°. A ramp angle means a rise from the inner level of the second recess 12. Alternatively preferably, the second recess 12 has the third chamfer 13*b* from the inner level to the relative elevation 13 with a ramp angle of more than 60°.

Preferably, towards the outside lying substantially opposite the first recess 11, the second recess 12 has an outwardly running fourth chamfer 12*a* which is configured such that a gap with a gap width is formed between the fourth chamfer 12*a* and the respective latching peg 21, wherein the gap width lies in the range from 0.3 to 1 mm or more. The fourth chamfer 12*a* here forms the gap, which is preferably wide enough for a screwdriver to be inserted in order to lever out the respective other housing part, so that the respective latching peg 21 can be pressed back out of the respective second recess 12 to the respective first recess 11.

Preferably, the first 1 or second housing part 2 having the first recesses 11 has a first chamfer 11*a* falling away laterally towards the outside from an outer edge of the respective first recess 11, wherein the first chamfer 11*a* falls away from the outer edge of the respective first recess 11 to a level which corresponds to the inner level of the respective first recess 11. In this way, when the first 1 and second housing part 2 are pushed into each other, the respective latching peg 21 can run along the respective first chamfer 11*a* from the outside in the direction of the respective first recess 11 under increasing stress until it snaps over the outer edge into the first recess 11. Preferably, the legs of the hinge connection are formed elastically to the side in the direction of the rotation axis, or the latching pegs 21 may also have an elastic height and for example be able to be extended and retracted.

Preferably, the hinge connection is configured such that from the second position to the first position, the second housing part 2 has a tangential movement direction which corresponds to the cutter inlet direction.

Preferably, the first 1 and/or the second housing part 2 and/or the connection block 3 consists substantially of one of the following materials or a mixture thereof or a composite material thereof: metal, plastic, polyurethane, polyethylene, duroplastic, thermo-plastic, with an insulating coating. Preferably, the first 1 and/or the second housing part 2 and/or the connection block 3 is an injection molding.

Preferably, the guide in the connection block 3 is configured such that in the second position, a respective insulation displacement portion of the respective wire lies directly above a respective wire insertion opening of the insertion slot of the respective ID termination 40, so that the respective insulation displacement portion can then be guided directly into the insertion slot in the cutter inlet direction Z.

Preferably, the first housing part 1 has a common plane for the one or more ID terminations 40, on which all cutter inlet directions Z for the respective ID terminations 40 stand perpendicularly. In other words, all cutter inlet directions Z of the respective ID terminations 40 run parallel to each other. Preferably, the common plane runs parallel to the first housing part longitudinal axis X.

Preferably, in the second position, the second housing part longitudinal axis of the second housing part 2 runs parallel to the first housing part longitudinal axis X of the first housing part 1.

Preferably, the first outer face 14 of the first housing part 1 runs substantially perpendicularly to the cutter inlet direction Z, or at least a portion of the first outer face 14 as shown in FIG. 3.

Preferably, in the second position, the second outer face 24 of the second housing part 2 runs substantially perpendicularly to the cutter inlet direction Z, or at least a portion of the second outer face 24 as shown in FIG. 3.

Preferably, along the first housing part longitudinal axis X, the first housing part 1 has a front portion 1*a*, a middle portion 1*b* and a rear portion 1*c*, wherein the respective plug contact 42 is arranged in the front portion 1*a*, the respective ID termination 40 is arranged in the middle portion 1*b*, and a tension and compression relief means for clamping the cable is arranged in the rear portion 1*c*.

For clarity, it is pointed out here that the respective ID termination 40 always means an ID termination 40 of just one or of a plurality of ID terminations 40.

Preferably, the respective ID termination 40, with the respective wire insertion opening and the respective predefined wire insertion plane in which the respective wire is to be inserted into the ID termination 40, is arranged in the first housing part 1 such that the respective wire insertion plane forms an angle to the first housing part longitudinal axis X, wherein the angle is greater than 30°. In this way, the respective wire is guided out from the plug-type connector at the side, and a surplus length at the plug-type connector can be cut off at the side after the wire has passed through the respective ID termination 40. For clarity, the wire insertion plane is the plane which is formed on insertion of a straight clamping portion of the wire in the cutter inlet direction.

Preferably, the respective wire channel 32 in the connection block 3 is formed with the first channel portion for the entry of the respective wire, a third channel portion for the outlet of the respective wire, and an intermediate second channel portion. Here, the respective first channel portion guides the respective wire substantially in the direction of a cable longitudinal axis of a cable end portion from which the respective wire protrudes. The respective second channel portion constitutes a cavity with a second diameter, or an inner width, which is greater than the first diameter of the respective first channel portion and greater than a second diameter of the respective second channel portion. In this way, the respective wire can be bent freely therein and transferred from the first to the respective third channel portion. The respective third channel portion preferably lies above the inlet opening and above the respective insertion slot of the respective ID termination 40. Preferably, the respective third channel portion lies substantially in the wire insertion plane of the respective ID termination 40.

Preferably, in the first housing part 1 next to the respective ID termination 40, a respective cutting means 41 for cutting the surplus length of the respective wire is arranged such that the respective wire insertion plane is cut, in order to cut off the respective surplus length of the respective wire which protrudes behind the ID termination 40. For the sake of clarity, the surplus length begins in the region behind the emergence of the respective wire after passing through the respective ID termination 40. It need not therefore be cut directly behind the ID termination, but the surplus length is preferably cut at a predefined distance from the respective ID termination 40.

Preferably, the respective cutting means 41 is arranged fixedly in the first housing part 1, wherein the connection block 3 has a corresponding respective cutting means recess 31 which at least partially receives the respective cutting means 41 in the third position.

Preferably, the respective ID termination 40 is electrically connected to the respective plug contact 42 via a circuit board, a respective contact wire or integrally.

Preferably, the plug-type connector is an RJ45 plug-type connector with one or a plurality of connection contacts 42 and wires.

Preferably, the connection block 3 is configured as a separate part and can be inserted in and/or connected to the second housing part 2. Preferably, the connection block 3 is integrally connected to the second housing part 2 or formed as one piece therewith.

Preferably, the first 1 and/or the second housing part 2 comprises the at least one tension and compression relief means in order to hold the cable securely against tension and compression in the plug-type connector.

Preferably, the first 1 and second housing part 2 are configured to form a cable channel between them, which determines a cable guide direction along a cable channel longitudinal axis, wherein the cable channel contains at least one tension and compression relief means for fixing the cable securely against tension and compression. The first 1 and the second housing part 2 are configured such that, in a non-mounted state which preferably exists in the first position, they open the cable channel at the side for cable insertion, and close it in a mounted state which preferably exists in the third position. The at least one tension and compression relief means here comprises at least one leaf spring element 5 having a middle part 50 and a first side part 52 and second side part 52*b* each bent away therefrom. Here, the first side part 52 is elastically bent away from the middle part 50 via a first bending edge 51, and the second side part 52*b* is elastically bent away from the middle part 50 via a second bending edge 51*b* which lies opposite the first bending edge 51 on the middle part 50.

The middle part 50 extends along a middle part longitudinal axis between the first 51 and second bending edge 51*b*, wherein the first 51 and second bending edge 51*b* are each formed perpendicularly to the middle part longitudinal axis. The middle part longitudinal axis lies substantially in a common plane with the cable channel longitudinal axis.

Here, the first side part 52 may assume a variable acute first angle to the middle part 50, and the second side part 52*b* may assume a variable acute second angle to the middle part 50. A first end portion 53 of the first side part 52 lying opposite the first bending edge 51 may assume a variable first height towards the middle part 50, and a second end portion 53*b* of the second side part 52*b* lying opposite the second bending edge 51*b* may assume a variable second height towards the middle part 50.

The first 52 and second side part 52*b* constrict the cable channel so far that, in mounted state of the plug-type housing with the cable inserted, the respective first 53 and second end portion 53*b* press against the cable with the respective elastic force and thus fix the cable securely against tension and compression. The tension- and compression-resistant fixing is achieved in that the respective end portions 53, 53*a* preferably engage in a cable casing of the cable, which is preferably resilient, under elastic spring force. The elastic spring force is preferably produced by the elastic leaf spring element 5, since the first 52 and the second side part 52*b* bend elastically when the cable is clamped in-between. The at least one leaf spring element 5 may be arranged in the cable channel such that the cable is clamped between two opposing leaf spring elements 5, or between a respective leaf spring element 5 and an opposing wall portion of the cable channel.

Figure 12:
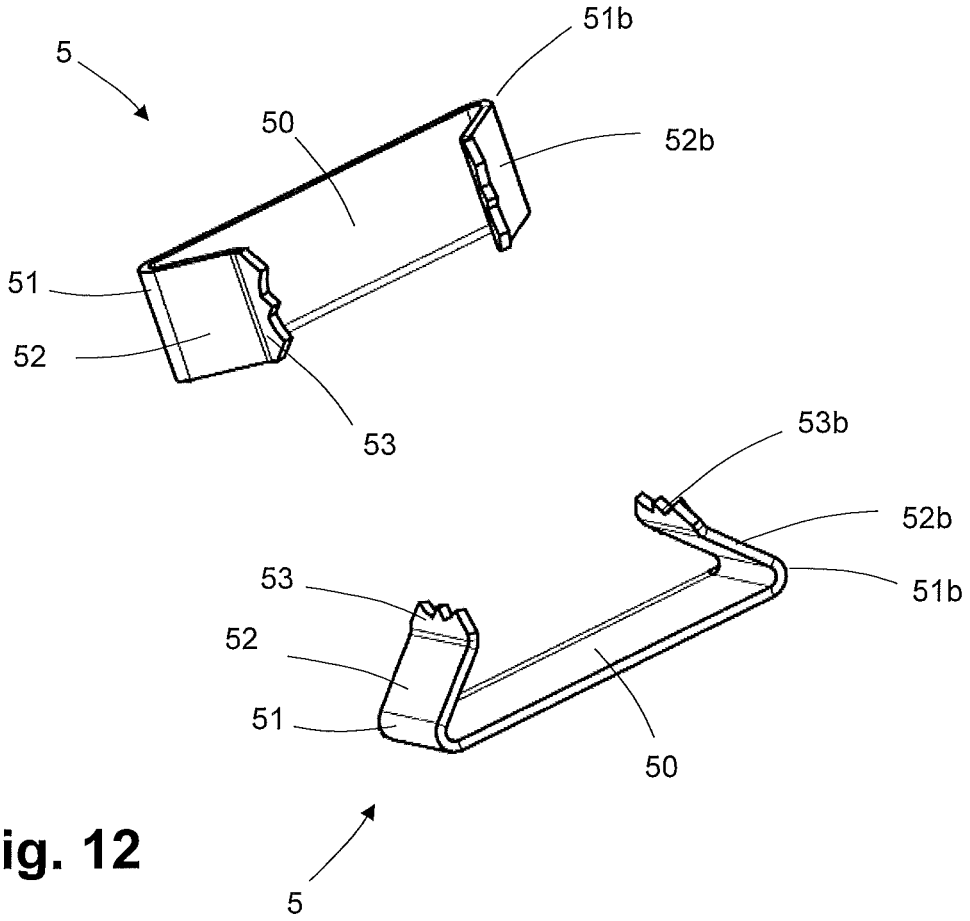
FIG. 12 shows two perspective views of another preferred tension and compression relief means.
Figure 13:
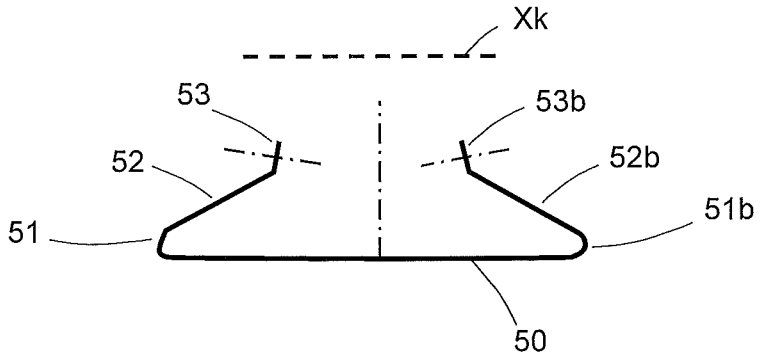
FIG. 13 is a side view of the tension and compression relief means from FIG. 12 showing respective mid-perpendiculars and a cable channel axis lying above the tension and compression relief means.

FIGS. 12 and 13 show a preferred embodiment of the leaf spring element 5.

Preferably, the first end portion 53 is bent away from the first side part 52 via a further bending edge and forms a first end portion face with a first mid-perpendicular which has an angle of 0 to 30° to the cable channel longitudinal axis in the relaxed state. In FIG. 13, the first mid-perpendicular is drawn in dotted lines.

Preferably, the second end portion 53*b* is bent away from the second side part 52*b* via a second further bending edge and forms a second end portion face with a second mid-perpendicular which has an angle of 0 to 30° to the cable channel longitudinal axis in the relaxed state. In FIG. 13, the second mid-perpendicular is drawn in dotted lines.

Preferably, the further bending edge or the second further bending edge is parallel to the respective first 51 or second bending edge 52*b*.

Preferably, the middle part 50 is connected to the first 1 and/or second housing part 2 inside the cable channel by at least one of the following connections: a hole-peg joint, a mastic joint, a welding, a soldering, a bolted joint, a riveted joint, a clamping joint, a clamping joint in a recess, a vulcanization joint, a groove-peg joint, or a combination thereof. Preferably, the tension and compression relief means has for this the first mechanical contact element 57 which for example may be a hole, a peg, a rough surface, two opposite edges, or a bore. Preferably, the first 1 and/or the second housing part 2 has for this a second mechanical contact element 15 corresponding to the first mechanical contact element 57.

Preferably, the middle part 50 is integrally connected to the first 1 and/or second housing part 2.

Preferably, the middle part 50 has a mid-perpendicular which forms an angle in a range from 70° to 90° to the cable channel longitudinal axis. In FIG. 13, the mid-perpendicular of the middle part 50 is drawn in dotted lines.

Preferably, the middle part longitudinal axis is formed parallel to the cable channel longitudinal axis or has an angle to this in the range of 0° to 20°.

Preferably, the middle part 50 extends flat and substantially in a middle part plane between the first 51 and second bending edge 51*b*.

Preferably, the first bending edge 51 points in the direction of a first cable end, from which at least one wire protrudes in order to be connected to a plug contact 42 in the plug-type housing, wherein the second bending edge 51*b* points in the direction of a second opposite cable end, wherein the second cable end is remote from the plug-type connector.

Preferably, the first 51 and the second bending edge 51*b* each run along a straight line. Preferably, the first 51 and the second bending edge 51*b* are each an elastic bending edge.

Preferably, the variable acute first angle in the relaxed state lies in a range from 30° to 45° or in a range from 45° to 60° or in a range from 60° to 70°.

Preferably, the variable acute second angle in the relaxed state lies in a range from 30° to 45° or in a range from 45° to 60° or in a range from 60° to 70°.

Preferably, the variable first height is formed substantially by the variable first angle, and the variable second height is formed substantially by the variable second angle.

Preferably, the leaf spring element 5 has substantially a constant width along the middle part 50 and along the first 52 and second side part 52*b*.

Figure 10:
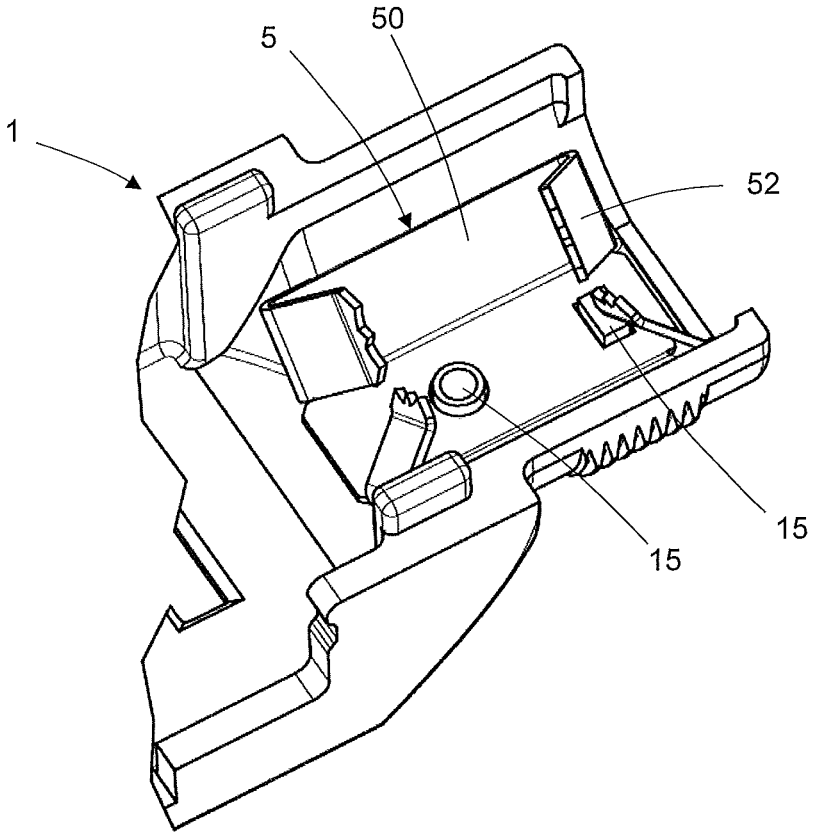
FIG. 10 is a perspective view of a rear portion of the first housing part from FIG. 1 with a preferred tension and compression relief means arranged therein.
Figure 11:
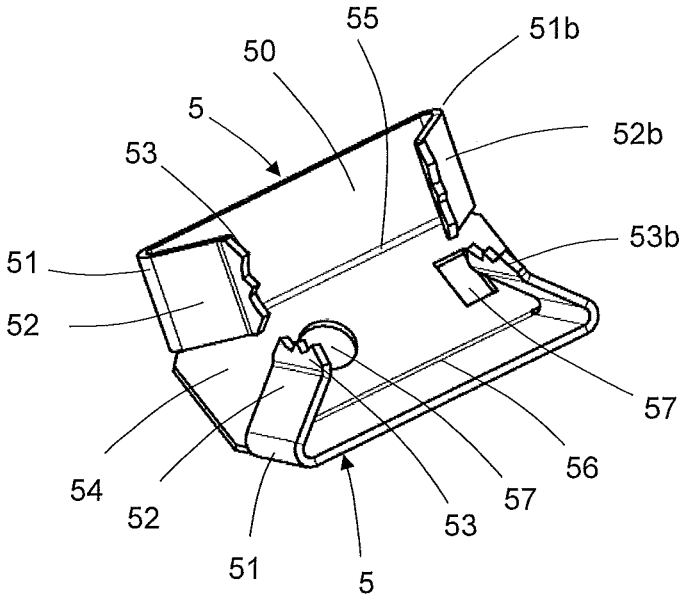
FIG. 11 is a perspective view of the preferred tension relief means from FIG. 10.

FIG. 10 and FIG. 11 show a preferred tension and compression relief means which comprises a first leaf spring element 5 and a second leaf spring element 5 which are integrally connected together via a connecting portion 54.

Here, at the side and parallel to the middle part longitudinal axis, a first middle part 50 of the first leaf spring element 5 has a third bending edge 55 which also forms a connection to the connecting portion 54. The connecting portion 54 has a connecting portion longitudinal axis which is parallel to the middle part longitudinal axis.

Here, on the side opposite the third bending edge 55, the connecting portion 54 has a fourth bending edge 56 parallel thereto which also forms a connection to the second middle part 50 of the second leaf spring element 5. Here, a second middle part longitudinal axis of the second middle part 50 runs parallel to the connection portion longitudinal axis and to the first middle part longitudinal axis. The first and second leaf spring elements 5 are bent towards each other via the respective third 55 and fourth bending edge 56, such that a respective mid-perpendicular of the respective middle part 50 points towards the cable channel longitudinal axis. For the sake of clarity, it is pointed out that the respective mid-perpendicular of the middle part 50 stands perpendicularly to the respective surface at a respective geometric center point of the middle part 50.

Preferably, the at least one tension and compression relief means comprises the first leaf spring element 5 and at least one further leaf spring element 5, which are integrally connected together with no intermediate connecting portion. At the side and parallel to the middle part longitudinal axis, a first middle part 50 of the first leaf spring element 5 has the third bending edge 55, which also forms a connection to a nearest side of the respective other middle part 50 of the further leaf spring element 5. Here, all respective middle part axes are parallel to each other. The first and further leaf spring elements 5 are bent towards each other via the third bending edge 55 such that the respective mid-perpendicular of the respective middle part 50 points towards the cable channel longitudinal axis. Preferably, a plurality of leaf spring elements 5 are connected together in this way.

Preferably, the first mechanical contact element 57 is arranged in one of the middle parts 50 or in one of the connecting portions 54.

For the sake of clarity, it is pointed out that the terms "upper", "lower", "top side", "underside" and other relative spatial indications lie in the vertical direction and as shown in the figures, unless described in a different orientation.

For clarity, it is pointed out that the terms "insertion" of the wire into the ID termination 40, and "pressing" of the wire into the ID termination 40, are synonymous.

For clarity, it is pointed out that the cutter inlet direction Z, and a longitudinal direction of the insertion slot of the ID termination 40 in which the wire is introduced or pressed, have the same orientation. The wire itself in a clamped state preferably runs substantially perpendicularly to the cutter inlet direction Z, wherein deviations are conceivable, as known to the skilled person from the prior art.

For clarity, the term "plug contact" preferably means an electromechanical plug contact for electrical connection to a matching other plug contact of another plug-type connector corresponding to the plug-type connector. For clarity, the respective plug contact in mounted state is preferably connected both mechanically and electrically to the respective ID termination 40. In general, the term "ID termination" is equivalent to the term "insulation displacement contact". For the sake of clarity, the wire comprises at least one core and an external insulation.

Further possible embodiments are described in the following claims. In particular, the various features of the above-mentioned embodiments may be combined with each other unless technically excluded.

The reference signs given in the claims serve for greater clarity and in no way restrict the claims to the forms shown in figures.

LIST OF REFERENCE SIGNS

1 First housing part
1*a* Front portion

1*b* Middle portion
1*c* Rear portion
11 First recess
11*a* First chamfer
11*b* Outer edge
12 Second recess
12*a* Fourth chamfer
13 Relative elevation
13*a* Second chamfer
13*b* Third chamfer
14 First outer face
15 Second mechanical contact element
2 Second housing part (preferably pivotable housing cover)
2*b* Second middle portion
2*c* Second rear portion
21 Latching peg
24 Second outer face
3 Connection block
30 ID termination recess
31 Cutting means recess
32 Wire channel
33 Latching lug
40 ID termination
41 Cutting means
42 Plug contact
5 Leaf spring element
51 Middle part
52 First side part
52*b* Second side part
53 First bending edge
54 Connecting portion
55 Second bending edge
56 Third bending edge
57 First mechanical contact element
X First housing part longitudinal axis
Z Cutter inlet direction

The invention claimed is:

1. A plug-type connector for connecting a cable with at least one wire to a respective plug contact (42), comprising:

a first housing part (1) with a first housing part longitudinal axis (X), comprising at least one plug contact (42) and at least one insulation displacement termination (40) which is electrically connected to the respective plug contact (42) and configured such that it has an insertion slot with a cutter inlet direction (Z) for a respective wire, in order to clamp the respective wire therein;

a connection block (3) with a respective wire channel (32) for guiding the respective wire; and a second housing part (2) with a second housing part longitudinal axis, comprising the connection block (3), wherein the first housing part (1) and the second housing part (2) are connected together by a common hinge connection with a rotation axis, wherein the hinge connection is configured such that the second housing part (2) can be pivoted about the rotation axis towards the first housing part (1) from a first position into a second position, wherein in the first position the respective wire can be inserted into the respective wire channel (32) of the connection block (3), and in the second position the second housing part (2) just begins to press the connection block (3), with the respective wire guided in the respective wire channel (32), against the respective insulation displacement termination (40), wherein the hinge connection is configured to allow the second housing part (2) to move on the first housing part (1) out of the second position into a third position, in which the connection block (3), with the respective wire guided in the respective wire channel (32), is fully pressed onto the at least one insulation displacement termination, and wherein the hinge connection is furthermore configured to allow an insertion movement from the second position into the third position such that the second housing part (2) can be displaced exclusively in a translational fashion in the cutting direction (Z) towards the first housing part (1), wherein the respective wire is also inserted into the respective insulation displacement termination (40) in an exclusively translational fashion.

2. The plug-type connector as claimed in claim 1, wherein the hinge connection is configured such that in a rotation axis region, in each case lying laterally outwardly opposite each other, the first housing part (1) has first recesses (11) which are formed along the rotation axis and receive two respective latching pegs (21) of the second housing part (2), wherein in the rotation axis region, the second housing part (2) has two legs which surround the first housing part (1) in the rotation axis region and comprise the two respective latching pegs (21), wherein the two latching pegs (21) extend towards each other.

3. The plug-type connector as claimed in claim 2, wherein the first housing part (1) comprises two second recesses (12) which are arranged relative to the first recesses (11) such that in the third position, the two latching pegs (21) lie in the two second recesses (12).

4. The plug-type connector as claimed in claim 3, wherein a respective channel is formed between the first recesses (11) and the second recesses (12) in order to guide the respective latching peg (21) from the second position into the third position in a straight line in the cutter inlet direction (Z).

5. The plug-type connector as claimed in claim 4, wherein between the respective first recess (11) and second recess (12), the channel has a relative elevation (13) which however lies lower than an outer level of the first recess (11) and second recess (12), in order to guide the respective latching peg (21) therein.

6. The plug-type connector as claimed in claim 2, wherein the first housing part has a first chamfer (11*a*) falling away laterally towards the outside from an outer edge of the respective first recess (11), wherein the first chamfer (11*a*) falls away from the outer edge of the respective first recess (11) to a level which corresponds to an inner level of the respective first recess (11), so that when the first (1) and second housing part (2) are pushed together, the latching pegs (21) run along the first chamfers (11*a*) from the outside under increasing stress until they snap over the outer edge into the first recesses (11).

7. The plug-type connector as claimed in claim 1, wherein the second housing part (2) is configured so as to be elastic in a region of the hinge connection.

8. The plug-type connector as claimed in claim 1, wherein the respective insulation displacement termination (40) with the respective wire insertion opening and a respective predefined wire insertion plane, in which the respective wire is to be inserted into the insulation displacement termination (40), is arranged in the first housing part (1) such that the respective wire insertion plane forms an angle to the first housing part longitudinal axis (X) which is greater than 30°, so that the respective wire is guided out from the plug-type connector at a side and a surplus length at the plug-type connector can be cut off at the side after the wire has passed through the respective insulation displacement termination (40).

9. The plug-type connector as claimed in claim 1, wherein from the first housing part (1) next to the respective insulation displacement termination (40), a respective cutter (41) for cutting a surplus length of the respective wire is arranged next to the respective insulation displacement termination (40) and in an associated wire insertion plane and configured such that it partially cuts off the respective surplus length of the respective wire which protrudes behind the insulation displacement termination (40); and wherein the respective cutter (41) is arranged fixedly in the first housing part (1), and the connection block (3) has a corresponding respective cutter recess (31) which at least partially receives the respective cutter (41) in the third position.

10. The plug-type connector as claimed in claim 1, wherein the first (1) and second housing part (2) are configured to form a cable channel between them which determines a cable guide direction along a cable channel longitudinal axis and comprises at least one tension and compression relief means for fixing the cable securely against tension and compression, wherein the first (1) and the second housing part (2) in a non-mounted state open the cable channel at a side for cable insertion and close it in a mounted state, wherein the at least one tension and compression relief means comprises:

at least one leaf spring element (5) having a middle part (50) and a first side part (52) and second side part (52*b*) each bent away therefrom, wherein the first side part (52) is elastically bent away from the middle part (50) via a first bending edge (51), and the second side part (52*b*) is elastically bent away from the middle part (50) via a second bending edge (51*b*) which lies opposite the first bending edge (51) on the middle part (50);

wherein the middle part (50) extends along a middle part longitudinal axis between the first (51) and the second bending edge (51*b*), the first (51) and the second bending edge (51*b*) are each formed perpendicularly to the middle part longitudinal axis, and the middle part longitudinal axis lies substantially in a common plane with the cable channel longitudinal axis;

wherein the first side part (52) may assume a variable acute first angle to the middle part (50), and the second side part (52*b*) may assume a variable acute second angle to the middle part (50), and a first end portion (53) of the first side part (52) lying opposite the first bending edge (51) may assume a variable first height towards the middle part (50), and a second end portion (53*b*) of the second side part (52*b*) lying opposite the second bending edge (51*b*) may assume a variable second height towards the middle part (50);

wherein the first (52) and second side part (52*b*) constrict the cable channel so far that, in mounted state of the plug-type housing with the cable inserted, the respective first (53) and second end portion (53*b*) press against the cable with the respective elastic force and thus fix the cable securely against tension and compression.

11. The plug-type connector as claimed in claim 10, wherein the first end portion (53) is bent away from the first side part (52) via a further bending edge and forms a first end portion face with a first mid-perpendicular which has an angle of 0 to 30° to the cable channel longitudinal axis in a relaxed state; and wherein the second end portion (53*b*) is bent away from the second side part (52*b*) via a second further bending edge and forms a second end portion face with a second mid-perpendicular which has an angle of 0 to 30° to the cable channel longitudinal axis in the relaxed state.

12. The plug-type connector as claimed in claim 11, wherein the further bending edge or the second further bending edge is parallel to the respective first (51) or second bending edge (52*b*).

13. The plug-type connector as claimed in claim 10, wherein the middle part (50) is connected to the first housing part (1) inside the cable channel by at least one of the following connections: a hole-peg joint, a mastic joint, a welding, a soldering, a bolted joint, a riveted joint, a clamping joint, a clamping joint in a recess, a vulcanization joint, a groove-peg joint, or a combination thereof.

14. The plug-type connector according to claim 10, wherein the at least one tension and compression relief means comprises at least one first leaf spring element (5) and a second leaf spring element (5) which are integrally connected together via a connecting portion (54), wherein at the side and parallel to the middle part longitudinal axis, a first middle part (50) of the first leaf spring element (5) has a third bending edge (55) which also forms a connection to the connecting portion (54) having a connecting portion longitudinal axis parallel thereto, wherein on the side opposite the third bending edge (55), the connecting portion (54) has a fourth bending edge (56) parallel thereto which also forms a connection to the second middle part (50) of the second leaf spring element (5), so that the respective middle part longitudinal axes and the connecting portion longitudinal axis are parallel to each other, and the first and second leaf spring element (5) are bent towards each other via the respective third (55) and fourth bending edge (56) such that a respective mid-perpendicular of the respective middle part (50) points towards the cable channel longitudinal axis.

15. The plug-type connector as claimed in claim 10, wherein the at least one tension and compression relief means comprises at least the first leaf spring element (5) and at least one further leaf spring element (5) which are integrally connected together, wherein at the side and parallel to the middle part longitudinal axis, a first middle part (50) of the first leaf spring element (5) has the third bending edge (55) which also forms a connection to a nearest side of the respective other middle part (50) of the further leaf spring element (5), wherein all respective middle part axes are parallel to each other, wherein the first and further leaf spring elements (5) are bent towards each other via the third bending edge (55) such that the respective mid-perpendicular of the respective middle part (50) points towards the cable channel longitudinal axis.

* * * * *